US009670573B2

(12) United States Patent
Bergen et al.

(10) Patent No.: US 9,670,573 B2
(45) Date of Patent: Jun. 6, 2017

(54) METHOD FOR THE HOT-DIP COATING OF METAL STRIP, IN PARTICULAR STEEL STRIP

(71) Applicant: ThyssenKrupp Steel Europe AG, Duisburg (DE)

(72) Inventors: Jegor Bergen, Rheinberg (DE); Frank Spelleken, Dinslaken (DE); Michael Peters, Kleve (DE); Manuela Ruthenberg, Dortmund (DE); Friedhelm Macherey, Alpen (DE); Florian Spelz, Oberhausen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 107 days.

(21) Appl. No.: 14/765,716

(22) PCT Filed: Jan. 13, 2014

(86) PCT No.: PCT/EP2014/050474
§ 371 (c)(1),
(2) Date: Aug. 4, 2015

(87) PCT Pub. No.: WO2014/121979
PCT Pub. Date: Aug. 14, 2014

(65) Prior Publication Data

US 2015/0376758 A1 Dec. 31, 2015

(30) Foreign Application Priority Data

Feb. 5, 2013 (DE) ..... 10 2013 101 132

(51) Int. Cl.

| | |
|---|---|
| ***C21D 9/52*** | (2006.01) |
| ***C23C 2/40*** | (2006.01) |
| ***C23C 28/02*** | (2006.01) |
| ***C21D 1/26*** | (2006.01) |
| ***C23C 2/06*** | (2006.01) |

(Continued)

(52) U.S. Cl.
CPC ..... *C23C 2/40* (2013.01); *C21D 1/26* (2013.01); *C21D 9/52* (2013.01); *C23C 2/06* (2013.01); *C23C 2/12* (2013.01); *C23C 28/025* (2013.01); *C23C 28/028* (2013.01); *C23F 17/00* (2013.01)

(58) Field of Classification Search
CPC .... C23C 2/40; C23C 2/12; C23C 2/06; C21D 9/52; C21D 1/26
See application file for complete search history.

(56) References Cited

FOREIGN PATENT DOCUMENTS

| | | |
|---|---|---|
| FR | 2374093 | 7/1978 |
| JP | 4236754 A | 8/1992 |
| JP | 4246158 A | 9/1992 |

*Primary Examiner* — Rebecca Lee
(74) *Attorney, Agent, or Firm* — The Wedd Law Firm

(57) ABSTRACT

A method for the hot-dip coating of metal strip, in particular steel strip, in a metallic melting bath (3) is disclosed. In the method, the metal strip (1) to be coated is heated in a continuous furnace (2) and is introduced into the melting bath (3) through a snout (6) which is connected to the continuous furnace and which is immersed into the melting bath. To be able to satisfy the requirements placed on the coated strip (1) with regard to good deformability of the strip, as far as possible without cracking and peeling, and with regard to high anti-corrosion protection in a more effective and reliable manner, the disclosure proposes that, in the region delimited by the snout (6), a melt is used which is intentionally implemented differently, in terms of its chemical composition, than the chemical composition of the melt used in the melting bath (3).

9 Claims, 5 Drawing Sheets

(51) Int. Cl.
*C23C 2/12* (2006.01)
*C23F 17/00* (2006.01)

METHOD FOR THE HOT-DIP COATING OF METAL STRIP, IN PARTICULAR STEEL STRIP

CROSS-REFERENCE TO RELATED APPLICATIONS

This application is the United States national phase of International Application No. PCT/EP2014/050474 filed Jan. 13, 2014, and claims priority to German Patent Application No. 10 2013 101 132.2 filed Feb. 5, 2013, the disclosures of which are hereby incorporated in their entirety by reference.

BACKGROUND OF THE INVENTION

Field of the Invention

The invention relates to a method for the hot-dip coating of metal strip, in particular steel strip, in a metallic melting bath, in which method the metal strip to be coated is heated in a continuous furnace and is introduced into the melting bath through a snout which is connected to the continuous furnace and which is immersed into the melting bath.

Description of Related Art

The hot-dip coating of metal strip, in particular steel strip, is a method that has been known for many years for the surface finishing of fine sheet-metal strip in order to protect it against corrosion. FIG. 3 illustrates, in a vertical sectional view, a section of a conventional installation for the hot-dip coating of a metal strip 1. A steel strip (fine sheet-metal strip) which is to be correspondingly finished is, for this purpose, initially cleaned, and subjected to recrystallization annealing, in a continuous furnace 2. Subsequently, the strip 1 is subjected to hot-dip coating by being led through a molten metal bath 3. As coating material for the strip 1, use is made for example of zinc, zinc alloys, pure aluminum or aluminum alloys.

The continuous furnace 2 typically comprises a directly heated preheater and indirectly heated reduction and holding zones, and also downstream cooling zones. At the end of the cooling zone, the furnace 2 is connected via a port (snout) 6 to the melting bath 3. A diverting roller (Pott roller) 7 arranged in the melting bath 3 causes the strip 1 entering the melting bath from the snout 6 to be diverted into a substantially vertical direction. The layer thickness of the metal layer which serves for anti-corrosion protection is normally set by way of stripping jets 5.

As a steel strip 1 passes through the melting bath 3, an alloy layer composed of iron and the coating metal is formed on the surface of the strip. Above this, the metal layer is formed whose composition corresponds to the chemical analysis of the metal melt situated in the melting bath vessel 4.

Depending on the melt composition, the coating has different characteristics, in particular with regard to mechanical and anti-corrosion protection characteristics. Also, the melt composition has an influence on the reliability of a process with regard to surface quality of the coated strip. In practice in the prior art, it is therefore the case that a corresponding composition of the metallic melting bath is selected in a manner dependent on the desired characteristics, that is to say, with a compromise solution, there is always a balancing act between the requirements such as, for example, the mechanical characteristics for the subsequent deformation of the coated fine metal sheet with the avoidance of cracks in the coating or peeling of said coating, on the one hand, and reliable anti-corrosion protection, on the other hand.

SUMMARY OF THE INVENTION

The present invention is based on the object of improving a method of the type mentioned in the introduction such that, with said method, the requirements placed on the coated strip with regard to good deformability of the strip or of a blank produced therefrom, as far as possible without cracking and peeling, and with regard to high anti-corrosion protection can be satisfied in an, as it were, effective and reliable manner.

To achieve said object, a method having the features of claim 1 is proposed. Preferred and advantageous embodiments of the method according to the invention are specified in the subclaims.

The method according to the invention is characterized in that, in the region delimited by the snout, a melt is used which is intentionally implemented differently, in terms of its chemical composition, than the chemical composition of the melt used in the melting bath. The invention thus proposes that melts of different composition (analysis) be used in the region delimited by the snout and in the rest of the melting bath. In this way, it is possible to set particular desired alloy coating characteristics in a highly variable and reliable manner.

It has been recognized by the inventors that, through the supply of alloy substances or correspondingly enriched coating metal directly into the port defined by the snout, it is possible for the melt composition in the port to be decoupled from the melt composition in the rest of the melting bath vessel. For example, it is the case here that the melt in the snout has a composition (analysis) which permits good mechanical deformability, whereas the melt in the rest of the melting bath vessel has a composition (analysis) which yields a good corrosion-resistant top layer.

A further advantage of the invention consists in that, owing to the relatively small volume of the melt in the snout and the process-induced consumption of said volume, the composition of the melt in the snout can be adapted or varied within a very short reaction time.

In this context, a preferred embodiment of the method according to the invention provides that the concentration of at least one chemical constituent of the melt used in the snout is monitored, and the chemical composition of said melt is adapted to a target value of the chemical composition in a manner dependent on the result of the monitoring. Said monitoring and the adaptation of the chemical composition of the melt are preferably performed automatically by means of a suitable monitoring and dosing device.

A further advantageous embodiment of the method according to the invention is characterized in that, as a snout, use is made of an elongated snout which ends at a distance in the range from 100 mm to 400 mm, preferably 100 mm to 300 mm, from the shell surface of a diverting roller which is arranged in the melting bath and which causes the strip entering the melting bath from the snout to be diverted into a substantially vertical direction. In this way, the melt that is supplied to the snout or used therein can be more reliably decoupled from the melt used in the rest of the melting bath vessel, giving rise, in the snout, to a volume region of at least adequate size in which the melt that is supplied or used there does not mix with the different melt used in the rest of the melting bath vessel.

A further advantageous embodiment of the method according to the invention provides that, as a snout, use is made of a snout whose immersed section is equipped with a narrowing portion and/or whose inner width or inner height tapers, at least over a length segment, in the direction of an outlet opening. In this way, too, the melt that is used in the snout can be decoupled from the melt used in the rest of the melting bath vessel, such that at least a volume region of adequate size of the melt supplied to the snout substantially does not mix with the different melt used in the rest of the melting bath vessel.

The elongated snout, which tapers in the direction of the outlet opening at least over a length segment, has the effect in particular of increasing the turbulence of the melt at and close to the metal strip. This turbulence promotes the decoupling of the melt that is supplied to the snout from the different melt used in the rest of the melting bath vessel.

To prevent an excessive amount of the melt that is used in the snout from being introduced into the rest of the melting bath, or to prevent mixing of the different melts, a further embodiment of the method according to the invention provides that, as a snout, use is made of a snout whose immersed section is equipped with a separating device or seal which prevents mixing of the melt situated in the snout and of the melt situated in the melting bath.

An advantageous embodiment of the method according to the invention is characterized in that an aluminum alloy comprising silicon is used as a melt in the region delimited by the snout, whereas a melt composed of pure aluminum is used in the melting bath. The pure aluminum in the melting bath is free from silicon, aside from inevitable impurities. In this way, it is possible to realize a hot-dip coated product, in particular steel strip, which firstly has a relatively thin alloy layer and is thus adequately ductile even for relatively intense deformations, and which secondly exhibits excellent corrosion resistance owing to the cover coating of pure aluminum.

Another advantageous embodiment of the method according to the invention consists in that an aluminum-zinc alloy comprising silicon is used as melt in the region delimited by the snout, whereas an aluminum-zinc alloy with a relatively reduced silicon content, or without silicon, is used as melt in the melting bath. In this way, too, it is possible to realize a hot-dip coated product, in particular steel strip, which, owing to the addition of silicon, has a relatively thin alloy layer and is thus adequately ductile for relatively intense deformations, and which exhibits excellent corrosion resistance owing to the surface layer formed from an aluminum-zinc alloy with reduced silicon content, or without silicon. If, in this case, an aluminum-zinc alloy without silicon is used as melt in the melting bath, it is self-evident that said melt is free from silicon aside from inevitable impurities.

A further advantageous embodiment of the method according to the invention is characterized in that a zinc-magnesium alloy is used as melt in the melting bath, whereas a zinc-magnesium alloy with a relatively reduced zinc, aluminum and/or magnesium content is used as melt in the region delimited by the snout. In this way, it is possible to realize a hot-dip coated metal strip, in particular steel strip, which is distinguished by particularly high surface quality and good mechanical deformability.

BRIEF DESCRIPTION OF THE DRAWINGS

The invention will be discussed in more detail below on the basis of a drawing, which illustrates several exemplary embodiments. In the drawing, in each case schematically.

DESCRIPTION OF THE INVENTION

Figure 1:
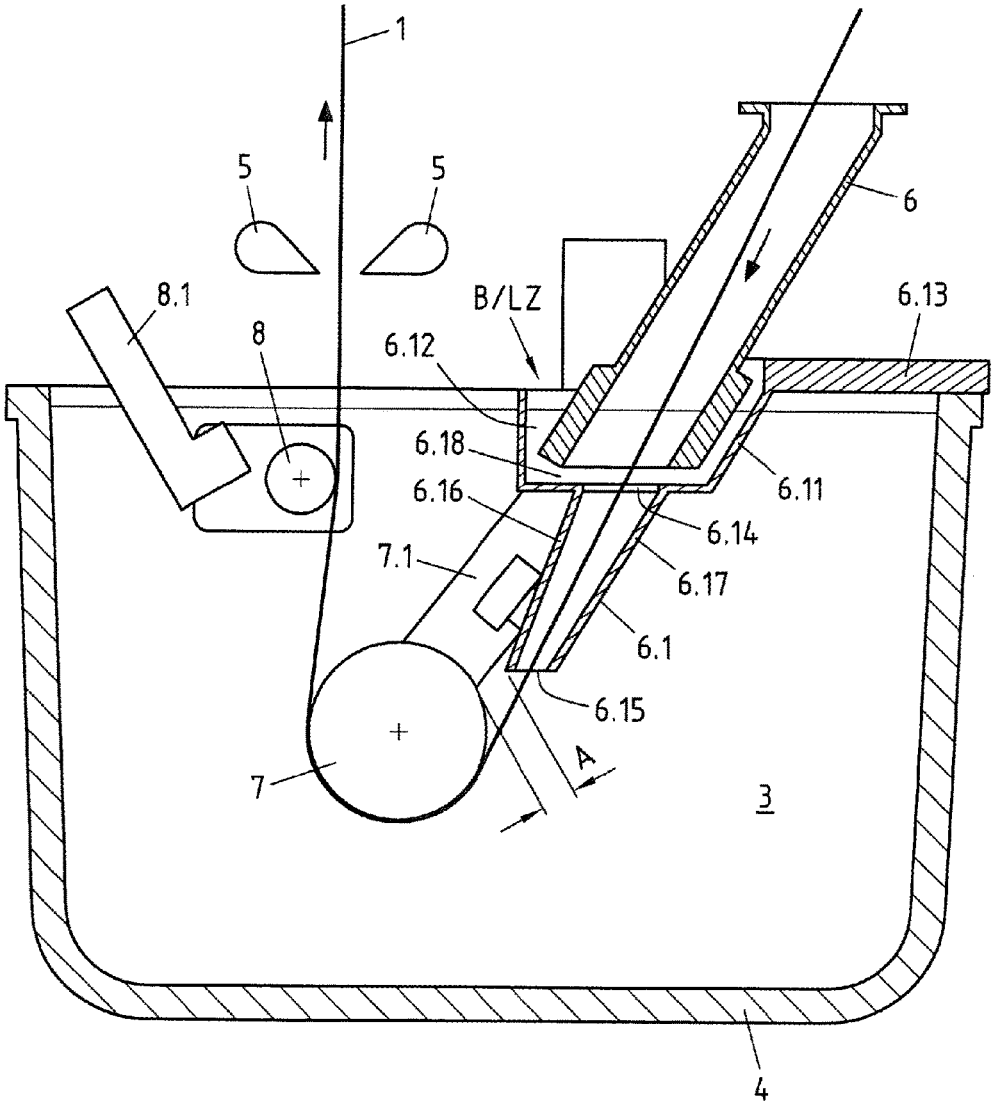
FIG. 1 shows a vertical sectional view of a melting bath vessel with an elongated snout, a diverting roller and a stabilizing roller.
Figure 2:
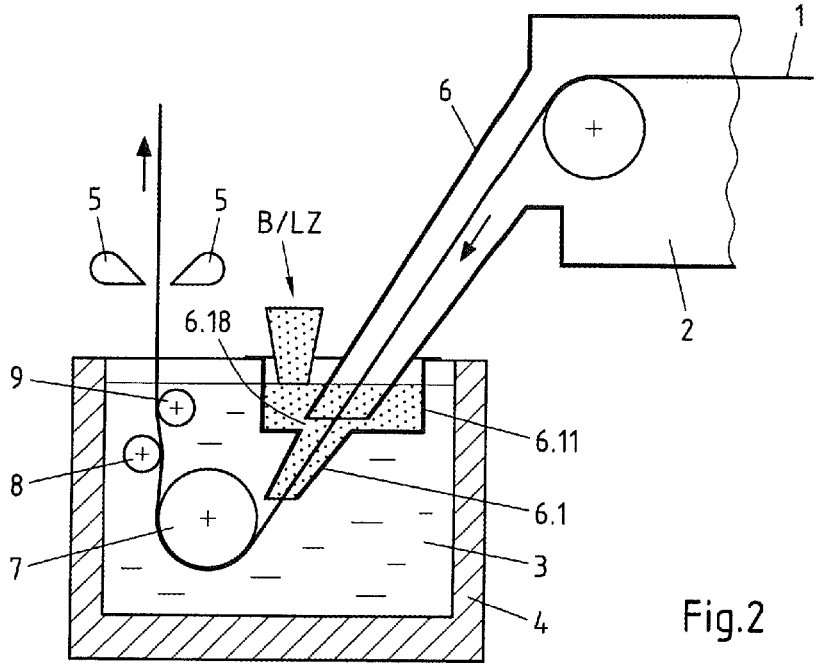
FIG. 2 shows a further exemplary embodiment of a device according to the invention, having a melting bath vessel, which is illustrated in vertical section, and two stabilizing rollers arranged therein.
Figure 3:
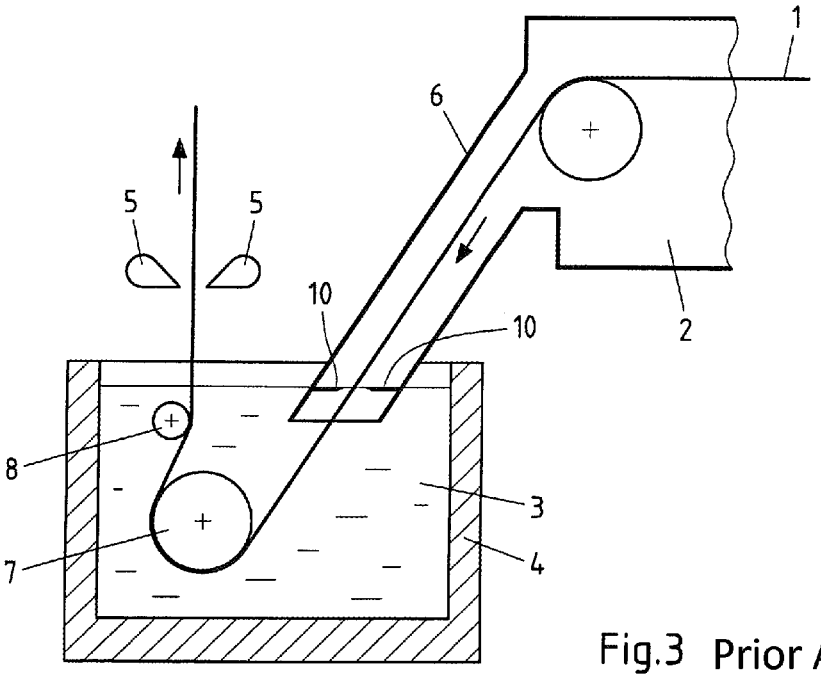
Fig.3 Prior Art
FIG. 3 shows a device for the hot-dip coating of metal strip as per the prior art, in a vertical sectional view.
Figure 4:
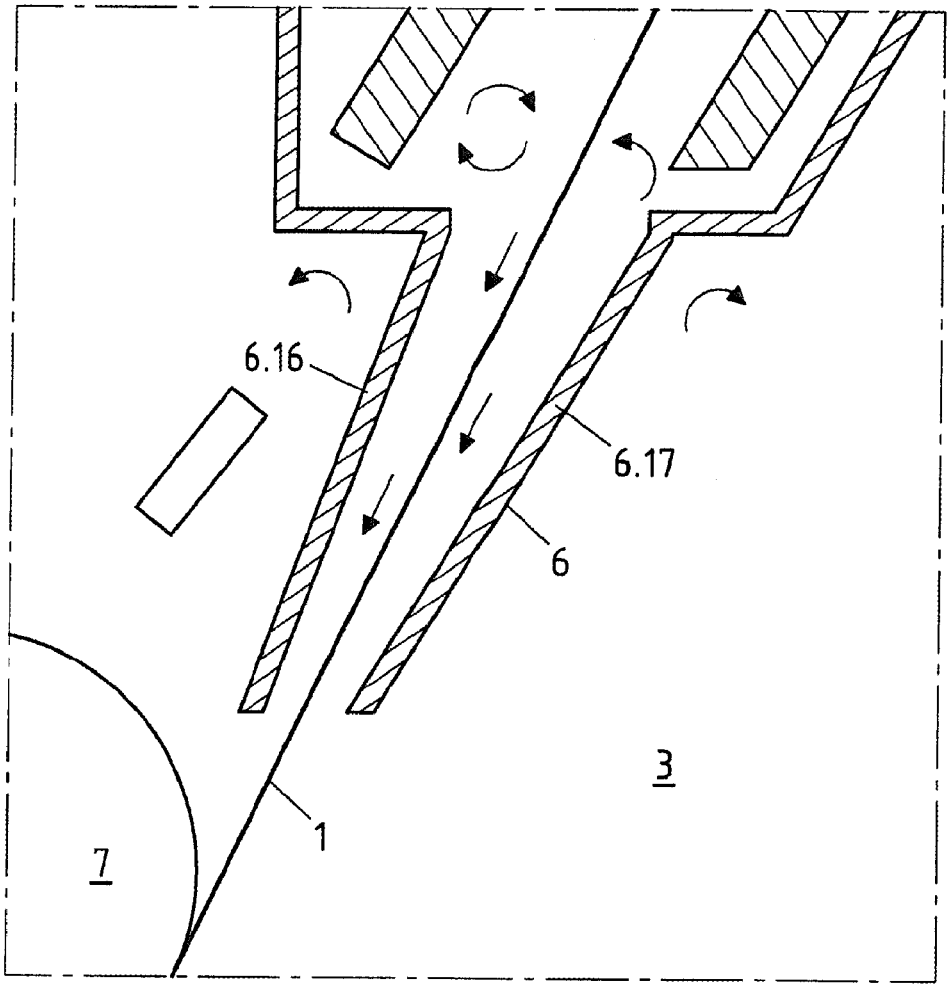
FIG. 4 shows a sub-region of a melting bath, with an indication of flow conditions in the case of a device according to the invention in the region of a snout elongation piece.

In the exemplary embodiments, illustrated in FIGS. 1, 2 and 4, of a device according to the invention for the hot-dip coating of metal strip, in particular steel strip, the snout 6 of a generic coating installation, which may correspond or corresponds substantially to the coating installation as per FIG. 3, is designed such that the immersed section of the snout 6 can have coating material B and/or at least one alloy additive LZ supplied to it separately. The device according to the invention is thus designed such that, in the region delimited by the snout 6, a melt can be implemented or used which is implemented differently, in terms of its chemical composition, than the chemical composition of the melt used in the melting bath 3.

For this purpose, the snout 6 is preferably equipped with a shaft-shaped snout elongation piece 6.1 for increasing the snout immersion depth. The snout elongation piece 6.1 has an attachment section 6.11 into which the lower end of the snout 6 projects. The attachment section 6.11 has a basin- or trough-shaped receiving chamber 6.12, the encircling side wall of which is fastened to a support 6.13 mounted on the upper edge of the melting bath vessel 4. In the base of the attachment section 6.11 or receiving chamber 6.12, there is formed an elongate opening 6.14 through which the metal strip 1 to be coated runs into the shaft-shaped snout elongation piece 6.1.

The snout 6 or the snout elongation piece 6.1 is preferably designed such that its clear inner width or clear inner height tapers toward the outlet opening 6.15 at least over a length segment. The tapering of the inner width or inner height arises from the fact that the walls 6.16, 6.17, facing toward the top side and bottom side of the strip 1, of the snout 6 or snout elongation piece 6.1 converge in the direction of the outlet opening 6.15. The inner width or inner height of the snout or snout elongation piece 6.1 is preferably characterized, in these exemplary embodiments, by a continuous tapering.

The outlet opening 6.15, or narrowest point of the snout elongation piece 6.1, preferably has a clear inner width of at most 120 mm, particularly preferably at most 100 mm. Furthermore, the snout elongation piece 6.1 is dimensioned so as to end at a distance A in the range from 100 mm to 400 mm, preferably 100 mm to 300 mm, from the shell surface of the diverting roller 7. The distance A between the lower end of the snout elongation piece 6.1 and the shell surface of the diverting roller 7 amounts to for example approximately 200 mm.

As is known per se, the diverting roller 7 is assigned a stabilizing roller 8 in order to ensure that the strip 1 passes in flat form, and in vibration-free fashion, through the flat jets 5, of the jet stripping device, arranged above the melt bath. The support arms of the diverting roller 7 and of the stabilizing roller 8 are denoted in FIG. 1 by 7.1 and 8.1. Furthermore, the stabilizing roller 8 may be combined with a guide or pressing roller 9 which is likewise arranged so as to be immersed (cf. FIG. 2).

In the exemplary embodiments of the device according to the invention illustrated in FIGS. 1 and 2, the attachment section 6.11 of the snout elongation piece 6.1 and the snout 6 define at least one feed duct 6.18 via which coating material B and/or at least one alloy additive LZ can be supplied separately into the immersed section of the snout 6 and/or into the snout elongation piece 6.1.

The elongation, according to the invention, of the snout 6 serves to realize the most extensive possible decoupling of the melt that is implemented or used in the snout 6 from the melt that is implemented/used in the rest of the melting bath vessel 4, which differs in terms of its chemical composition from the melt that is implemented/used in the snout 6. This gives rise, in the melting bath 3, to regions with different melt compositions, in order to implement particular desired alloy coating characteristics. This will be discussed in more detail below with reference to FIGS. 7 to 9.

Figure 7:
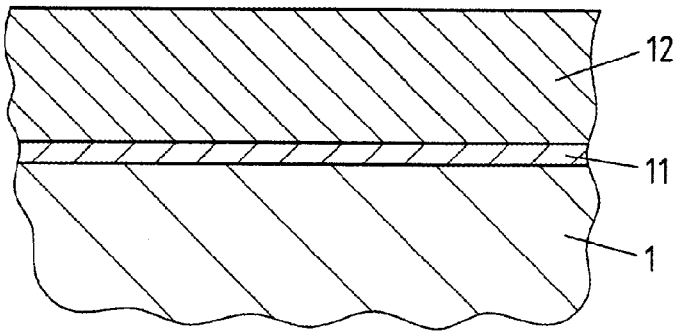
FIG. 7 shows a cross-sectional view of a section of a steel strip coated by immersion in an AlFeSi melt.

In the case of conventional hot-dip coating of steel strip with an aluminum melt which comprises approximately 10 wt % silicon, a relatively thin alloy layer 11 is formed at the interface between steel and coating metal (FIG. 7). The thickness of the alloy layer 11 amounts to for example approximately 4 μm. The alloy layer 11 is followed by the surface layer 12, situated thereabove, composed of aluminum and ferrosilicon inclusions. This coating, known under the trade name FAL type 1,is, owing to the thin alloy layer 11, ductile enough to permit satisfactory realization of desired deformations of the coated steel strip 1 or steel sheet. The anti-corrosion protection realized by means of this coating is however not as good as that realized in the case of a pure aluminum coating, with the trade name FAL type 2.

Figure 8:
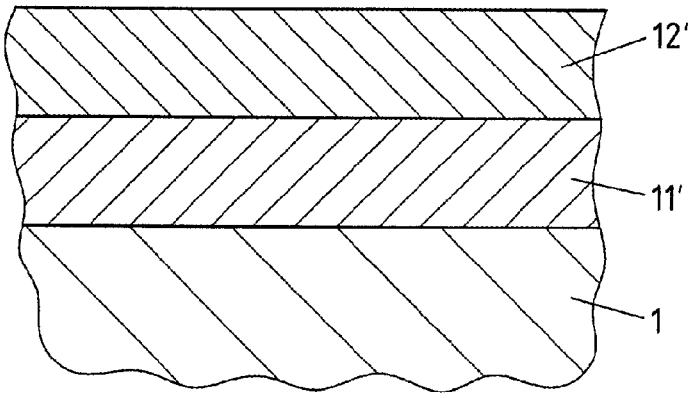
FIG. 8 shows a cross-sectional view of a section of a steel strip coated by immersion in a pure aluminum melt.

FIG. 8 shows a cross-sectional view of a section of a steel strip 1 coated by immersion in a pure aluminum melt. This lining provides excellent anti-corrosion protection. 12' denotes the surface layer composed of pure aluminum. Owing to the absence of silicon in the melt, a relatively thick alloy layer 11' forms at the interface between steel and coating metal. The thickness of the brittle alloy layer 11' may in this case amount to for example up to 20 μm. The brittle alloy layer 11' exhibits a tendency for crack formation, and for peeling of the metal coating, during the deformation of the coated steel strip 1 or steel sheet. Owing to the restricted ductility, this product (FAL type 2) is suitable only for simple components which do not require any intense deformations.

Figure 9:
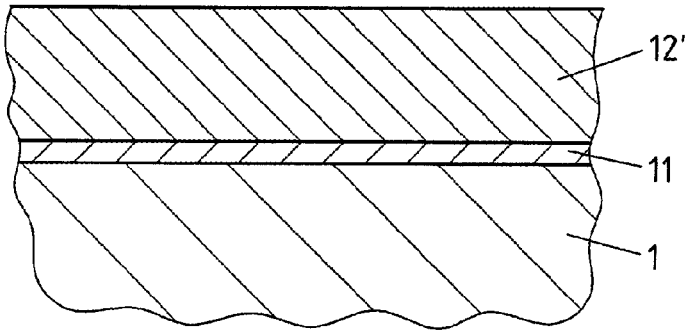
FIG. 9 shows a cross-sectional view of a section of a metal strip coated by immersion in two different metallic melts.

The device according to the invention illustrated in FIG. 1 or FIG. 2, in which the snout 6 and the attachment section 6.11 of the snout elongation piece 6.1 define at least one feed duct 6.18, makes it possible, for example, to enrich a melt comprising silicon in the snout 6, leading to a thin alloy layer 11 similar to the alloy layer of the product FAL type 1. For example, an AlFeSi coating material may be supplied to the snout 6 via the basin-shaped attachment section 6.11 of the snout elongation piece 6.1 and the feed duct 6.18. By contrast, it is preferably the case that a pure aluminum melt is used in the melting bath vessel 4 itself, such that a surface layer 12' composed of pure aluminum is obtained. This product ("FAL type 3"), which is depicted in FIG. 9, combines the advantages of the products FAL type 1 and FAL type 2. This is because, in this way, a product is obtained which, owing to the thin alloy layer 11, is ductile enough that desired relatively intense deformations can be realized, and which, furthermore, owing to the surface layer 12' composed of pure aluminum, exhibits excellent anti-corrosion protection characteristics.

Instead of a pure aluminum melt, it is also possible for some other metallic melt to be used in the melting bath vessel 4. For example, an aluminum-zinc melt may be used in the melting bath vessel 4, whereas, in the region delimited by the snout 6, a melt is used which is likewise based on an aluminum-zinc melt but which additionally has, or has had, silicon added to it for the purpose of suppressing or reducing the alloy layer, whereby improved deformability is attained.

A further example for the use, according to the invention, of melts with different chemical compositions is the use of a zinc-magnesium melt in the melting bath vessel 4, whereas a melt with reduced zinc, aluminum and/or magnesium content is used in the snout 6. In this way, it is possible to reduce instances of insufficient wetting in the coating of the strip 1, and thus to improve the surface quality of the hot-dip coated strip.

In the case of prior art coating systems as per FIG. 3, it is sometimes the case that slag 10 accumulates on the surface of the melt 3 within the snout 6, which slag can lead to flaws in the coating of the metal strip 1. Tests have shown that such slag-induced coating flaws can be prevented by increasing the depth of immersion of the snout 6 in conjunction with a tapering of the inner width or inner height of the immersed snout elongation piece 6.1 toward the outlet opening 6.15. The tapering of the snout elongation piece 6.1 in the direction of the outlet opening 6.15 furthermore contributes to the decoupling of the different melts that are used in the snout 6 and in the rest of the melting bath vessel 4.

Figure 5:
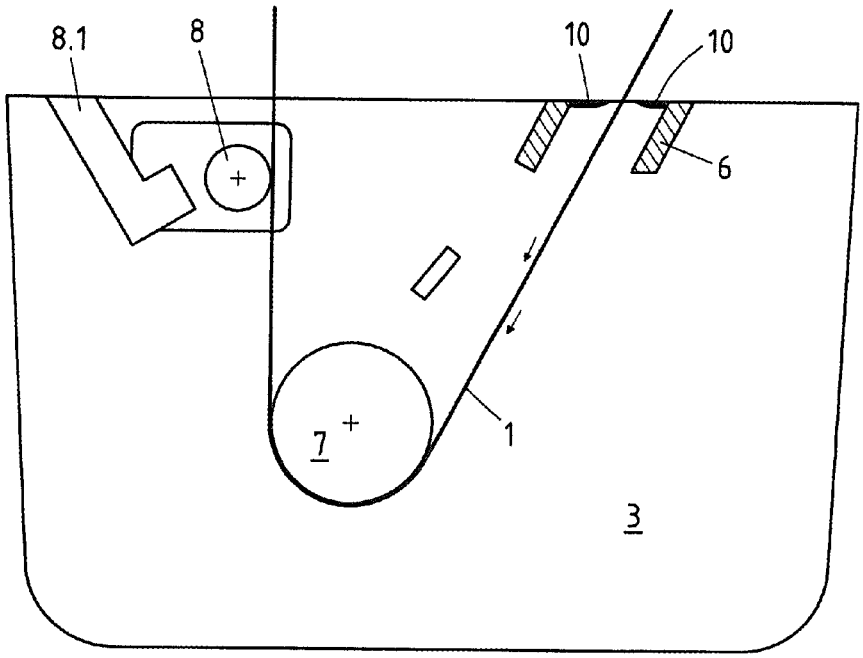
Fig.5 Prior Art
FIG. 5 shows a melting bath of a device for the hot-dip coating of metal strip as per the prior art.
Figure 6:
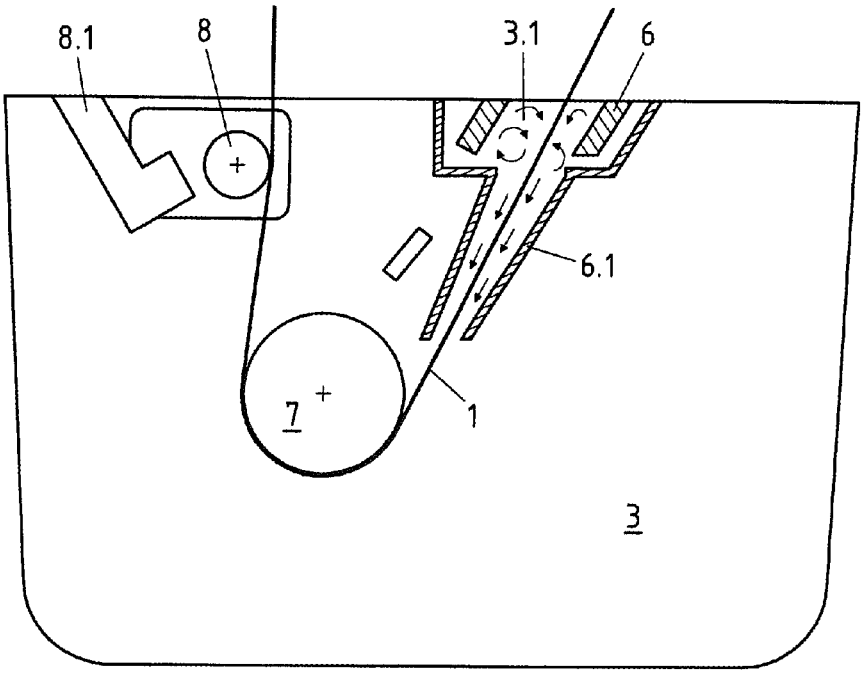
FIG. 6 shows a melting bath of a device according to the invention for the hot-dip coating of metal strip.

In FIGS. 5 and 6, the speed distribution of the melt flow encountered in the melting bath vessel during the operation of a prior art coating device (FIG. 5) and during the operation of a coating device according to the invention (FIG. 6) is depicted. A comparison of FIGS. 5 and 6 shows that, by means of the snout elongation 6.1, the flow in the snout 6, in particular in that region 3.1 of the melting bath surface enclosed by the snout 6, is intensified, which results in a continuous exchange of the melt at the melting bath surface in the snout 6. In this way, no slag, which causes surface flaws in the coating of the strip 1, can accumulate in that region 3.1 of the melting bath surface which is enclosed by the snout 6.

The embodiment of the invention is not restricted to the exemplary embodiments illustrated in the drawing. Rather, numerous variants are conceivable which make use of the invention specified in the appended claims even in the case of a different design. For example, it also falls within the scope of the invention for the inner width or inner height of the immersed snout elongation piece 6.1 to taper in the direction of its outlet opening 6.15 at least over a length segment in stepped form by way of one or more step changes in inner width or inner height, and/or by way of snout wall sections which are angled differently relative to one another. The snout elongation piece 6.1 may for example be assembled from multiple walls or wall sections which face toward the top side and bottom side of the strip 1. The (continuous) tapering of the inner width or inner height of the snout elongation 6.1 may thus also extend only over a length segment thereof.

The invention claimed is:

1. A method for hot-dip coating of metal strip, comprising heating the metal strip to be coated in a continuous furnace and introducing the heated metal strip into a melting bath through a snout which is connected to the continuous furnace and which is immersed into the melting bath, wherein, in a region delimited by the snout, a melt is used which is intentionally implemented differently, in terms of chemical composition, than the chemical composition of the melt used in the melting bath.

2. The method as claimed in claim 1, wherein a concentration of at least one chemical constituent of the melt used in the snout is monitored, and the chemical composition of the melt used in the snout is adapted to a target value of the chemical composition in a manner dependent on a result of the monitoring.

3. The method as claimed in claim 1, wherein the snout comprises an elongated snout which ends at a distance in a range from 100 mm to 400 mm from a shell surface of a diverting roller which is arranged in the melting bath and which causes the heated metal strip entering the melting bath from the snout to be diverted into a substantially vertical direction.

4. The method as claimed in claim 1, wherein an immersed section of the snout is equipped with a narrowing portion, and/or whose inner width or inner height tapers at least over a length segment, in a direction of an outlet opening.

5. The method as claimed in claim 1, wherein an immersed section of the snout is equipped with a separating device or seal which prevents mixing of the melt situated in the snout and of the melt situated in the melting bath.

6. The method as claimed in claim 1, wherein an aluminum alloy comprising silicon is used as the melt in the region delimited by the snout, whereas a melt composed of pure aluminum is used in the melting bath.

7. The method as claimed in claim 1, wherein an aluminum-zinc alloy comprising silicon is used as the melt in the region delimited by the snout, whereas an aluminum-zinc alloy with a relatively reduced silicon content, or without silicon, is used as a melt in the melting bath.

8. The method as claimed in claim 1, wherein a zinc-magnesium alloy is used as the melt in the melting bath, whereas a zinc-magnesium alloy with a relatively reduced zinc, aluminum and/or magnesium content is used as the melt in the region delimited by the snout.

9. The method as claimed in claim 3, wherein the distance is in the range of 100 to 300 mm.

* * * * *